US005788305A

United States Patent [19]

Hung

[11] Patent Number: 5,788,305

[45] Date of Patent: Aug. 4, 1998

[54] WHEEL BAG FOR AN IN-LINE SKATE

[76] Inventor: Tien-Mou Hung, P.O. Box 90, Tainan City 704, Taiwan

[21] Appl. No.: 825,815

[22] Filed: Apr. 3, 1997

[51] Int. Cl.[6] ..... A45F 5/10; B65D 63/18

[52] U.S. Cl. ..... 294/160; 294/141; 294/162; 294/165

[58] Field of Search ..... 294/137, 141–143, 294/145, 150, 149, 152, 157, 159, 160, 162–166, 170; 206/315.1; 211/34, 38; 224/250, 257, 575, 578, 600, 605, 609; 280/809, 811, 825

[56] References Cited

U.S. PATENT DOCUMENTS

| | | | |
|---|---|---|---|
| 3,796,357 | 3/1974 | Johnson | 294/159 X |
| 4,160,301 | 7/1979 | Woolley | 294/162 X |
| 4,779,362 | 10/1988 | Citrowske | 294/159 X |
| 4,867,359 | 9/1989 | Donovan | 294/162 X |
| 5,269,580 | 12/1993 | Hsiao | 294/162 |
| 5,603,545 | 2/1997 | Benson et al. | 294/159 X |
| 5,611,427 | 3/1997 | Bigham | 294/159 X |

*Primary Examiner*—Johnny D. Cherry

[57] ABSTRACT

A wheel bag for an in-line skate has an upper opening, two opening edges containing a constrict band, which has two ends extending out of one end and connected with a position fastener movable along the band, and then with a male fastener or a female fastener. Then two wheel bags can contain therein two wheel units of a pair of in-line skates and be constricted by the position fastener, with the male fastener of one wheel bag engaging with the female fastener of the other wheel bag. Then the two wheel bags with the wheel units of a pair of skates can be carried on a hand or a shoulder. Or the two wheel bags can contain a pair of shoes instead of a pair of skates when the skates are worn for skating. Or a user can wear the skates with the wheel bags covered on the wheel units and walk on the ground or upstairs or downstairs safely without sliding.

2 Claims, 4 Drawing Sheets

WHEEL BAG FOR AN IN-LINE SKATE

BACKGROUND OF THE INVENTION

This invention relates to a wheel bag for an in-line skate, particularly to that bound around a wheel unit of an in-line skate so as to carry a pair of skates by a user or a pair of shoes instead of a pair of skates worn by the user for skating for preventing the pair of shoes from becoming lost. Further, a pair of skates can be used to walk on the ground safely without sliding, with the wheel bags bound around the wheel units.

Among various sports, skating is a kind of sport widely popular for the young, esp. in countries such as =America, which have many well-paved roads or streets in cities for skating fans to skate along thereon. Even some people use skates to go to work, in addition to entertainment.

Skates are commonly carried in a bag and taken out of the bag for skating or put in the bag for carrying when not in use. To some people, repeating these actions may be a kind of trouble.

Common skates used nowadays have four wheels or in-line wheels, especially in-line skates are very popular these days. If a pair of shoes are displaced with a pair of skates for skating, then the pair of shoes have to be held in a bag or directly in a hand, which is not convenient.

Provided a person plays skating near his/her living house, he/she may wear a pair of skating indoors and go out with the skates worn on the feet, walking out and in. Then the floor of a room may be too slippery for the skates or the user has to go downstairs and upstairs. Or the wheel units of a pair of in-line skates may be soiled during skating and the floor of the room may be soiled by the skates when walked on by the user with the skates worn on.

SUMMARY OF THE INVENTION

One purpose of the invention is to offer a wheel bag bound around a wheel unit of an in-line skate so as to carry a pair of skates easily in a hand or on a shoulder or the neck.

Another purpose of the invention is to offer a wheel bag able to be bound around a wheel unit of an in-line skate and to contain a pair of shoes instead of the wheel units when the skates are in use for skating.

One more purpose of the invention is to offer a wheel bag able to be bound around the wheel unit and let a user to walk on the ground safely with a pair of skates worn on the feet.

A main feature of the invention is a longitudinal upper opening and a hollow space for containing a wheel unit of an in-line skate therein and the upper opening is closed up by a constrict band extending around two opening edges, and carried by means of a male fastener fixed with two ends of the constrict band of one wheel bag engaging a female fastener fixed with two ends of the constrict band of the other wheel bag. Further, a slide-proof sheet is fixed on an outer bottom of each wheel bag to prevent sliding during walking.

BRIEF DESCRIPTION OF DRAWINGS

This invention will be better understood referring to the accompanying drawings, wherein.

DESCRIPTION OF THE PREFERRED EMBODIMENT

Figure 1:
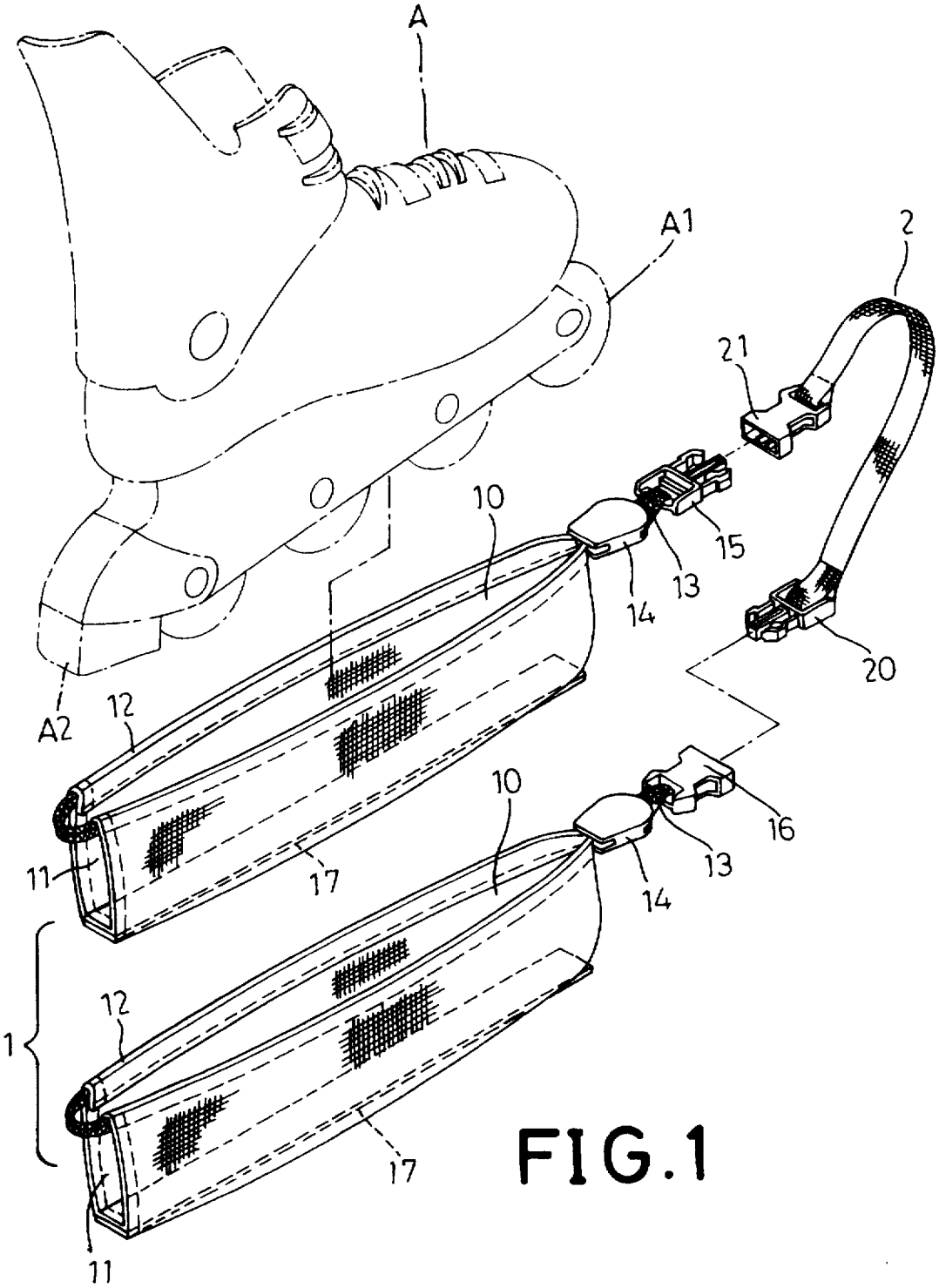
FIG. 1 is an exploded perspective view of a preferred embodiment of a wheel bag for an in-line skate in the present invention.

A preferred embodiment of a wheel bag for an inline skate includes a pair of wheel bags 1 made of soft cotton cloth cut and sewn together at a longitudinal bottom and one vertical side. Each wheel bag 1 has a longitudinal opening 10 in an upper side, a vertical opening 11 in a vertical side and a hollow interior. Two longitudinal edges 12, 12 define the opening 10, and a constrict band 13 is hidden to extend in the edges 12, 12 and has two ends extending out of a right end (as shown in FIG. 1) of the edges 12, 12 and connected with a position fastener 14 movable to constrict the constrict band 13 so as to close up the opening 10 after a wheel unit A1 of an in-line skate A is put in the hollow interior of the wheel bag 1. Then two ends of the constrict band 13 of a first wheel bag 1 are then connected with a male fastener 15, and the two ends of the constrict band 13 of a second wheel bag 1 are then connected with a female fastener 16. On the outer bottom of each wheel bag 1 is attached with a slide-proof sheet 17 made of durable and rough material such as rubber. Further, a carry band 2 is provided, having a male fastener 20 fixed at one end and a female fastener 21 fixed at the other end.

Figure 2:
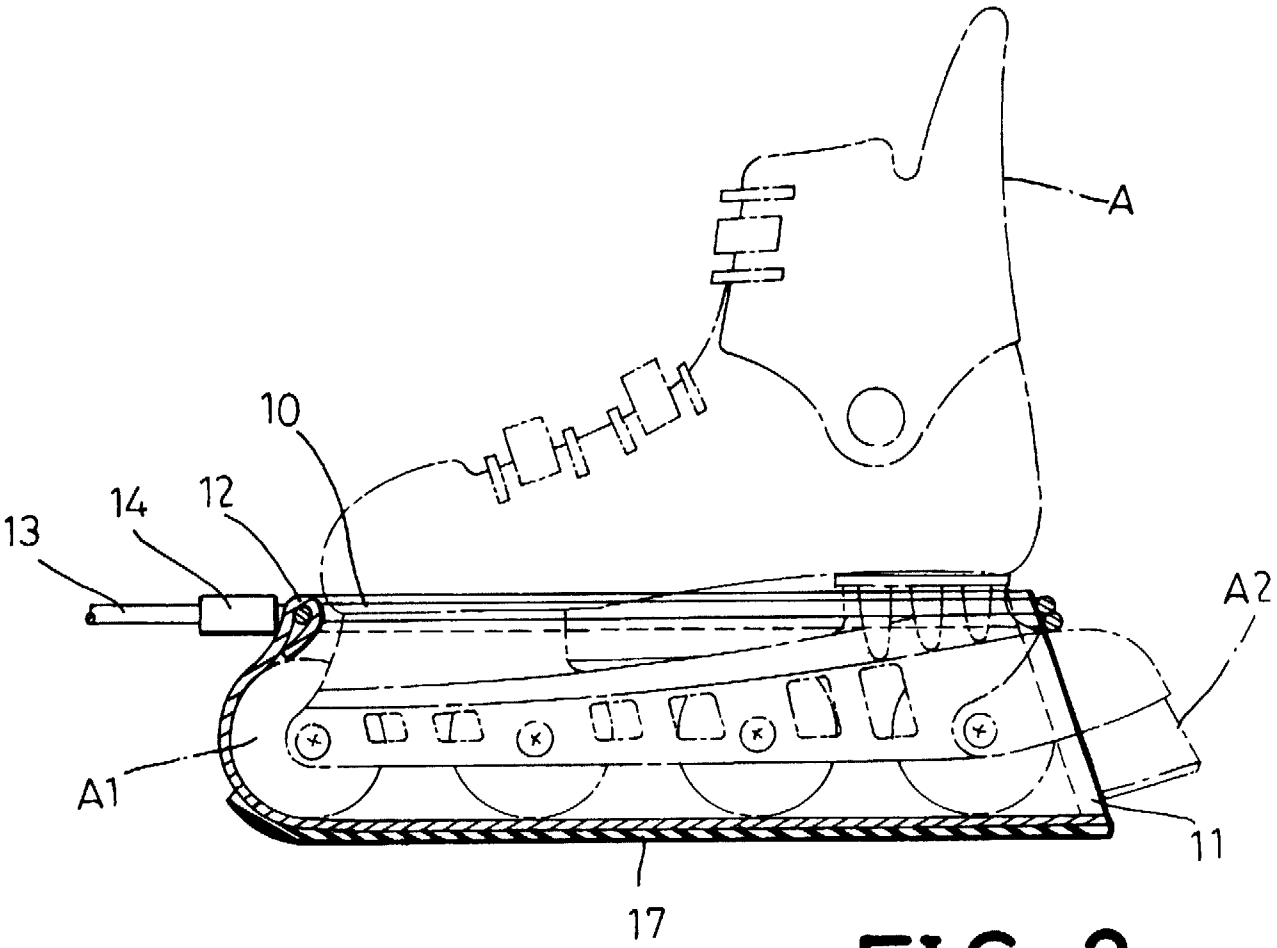
FIG. 2 is a cross-sectional view of the preferred embodiment of a wheel bag containing the wheel of an in-line skate.
Figure 3:
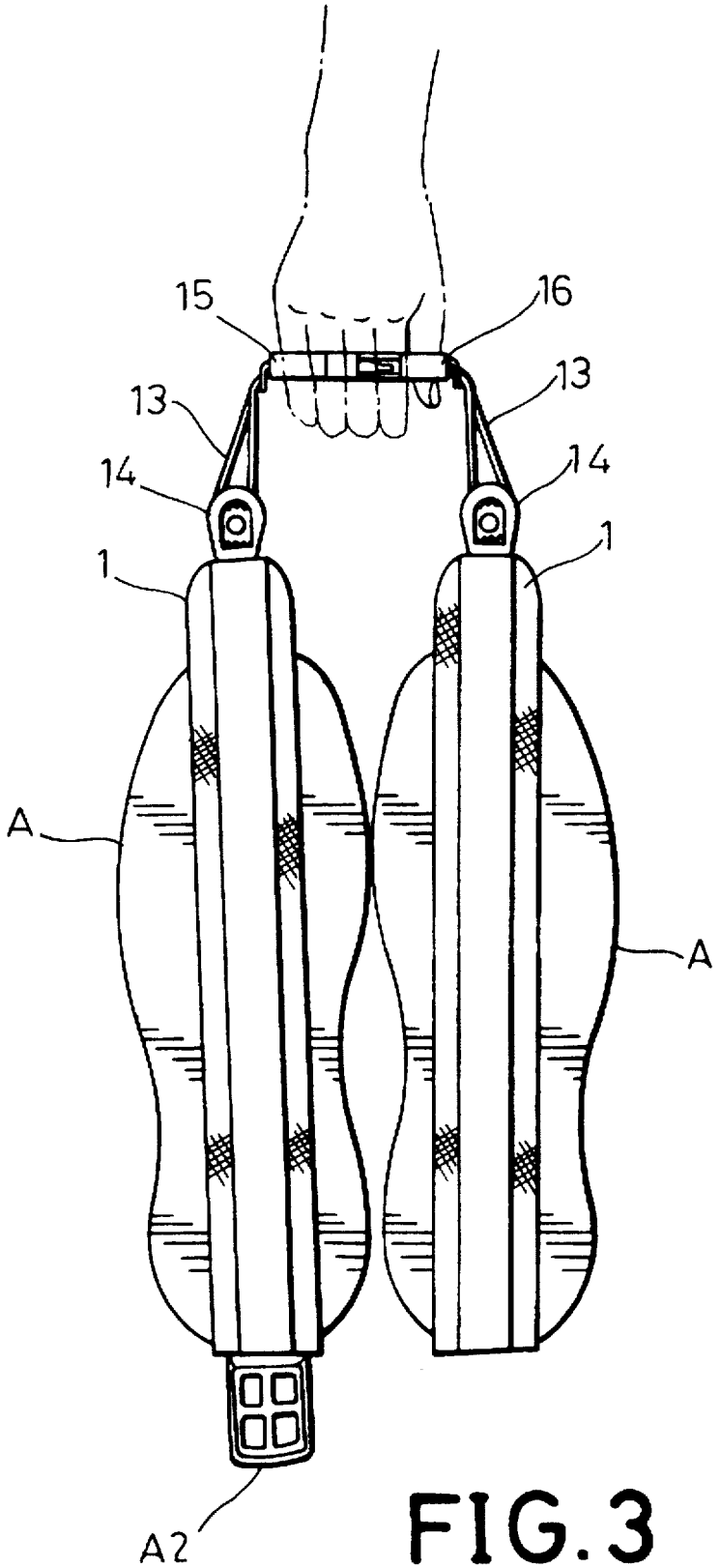
FIG. 3 is a side view of the preferred embodiment of a wheel bag used to carry and contain a pair of in-line skates; and, FIG. 4 is a side view of the preferred embodiment of a wheel bag used to carry a pair of in-line skates on a neck.
Figure 4:
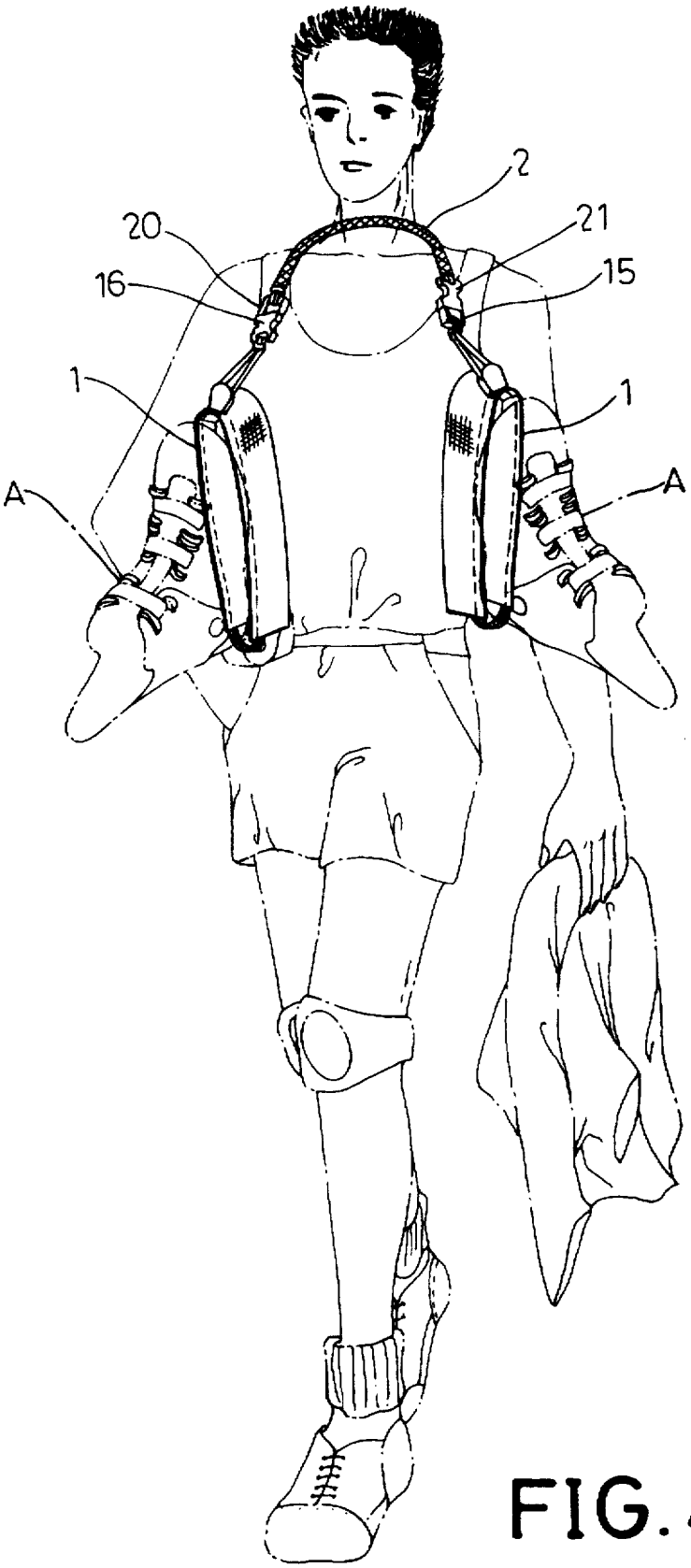

If a pair of in-line skates is wanted to be carried by the wheel bags 1, referring to FIG. 2, each wheel bag 1 is pushed towards a straight wheel unit A1 of the skate A, with the opening 10 facing and being protruded in by the wheel unit A1, with a brake block A2 of the skate A protruding out of the vertical opening 11 of the bag 1. Then each constrict band 13 of the edges 12, 12 is pulled straight to force the edges 12, 12 close up the opening 10 with the wheel unit A1 contained therein. Next, the position fasteners 14 are moved to the right ends (as shown in FIG. 1) of the opening 10 for shortening the length of the constrict band 13 so as to tightly close up the opening 10 and keep the wheel unit A1 of the in-line skate A in the bag 1. Then the male fastener 15 of one wheel bag 1 is engaged with the female fastener 16 of the other wheel bag 1 as shown in FIG. 3, or the male fastener 15 of one wheel bag 1 is engaged with the female fastener 21 of the carry band 2 and the female fastener 16 of the other wheel bag 1 is engaged with the male fastener 20 of the carry band 2, as shown in FIG. 3. Then the carry band 2 can be carried in a hand or can be hung on a shoulder or the neck of a user, as shown in FIG. 4.

When the pair of in-line skates are used in skating, a user puts his/her pair of shoes in the pair of the wheel bags 1, 1 and constricts the position fastener 14, with the male fastener 15 and the female fastener 16 respectively engaged with the female fastener 21 and the male fastener 20 of the carry band 2, keeping the shoes in the wheel bags 1, 1 without chances of losing or soiling the shoes, carried on a hand, a shoulder or the neck.

If a person wants to walk with the pair of in-line skates worn on the feet, referring to FIG. 2, the person puts the wheel bags 1, 1 around the wheel units A1, A1 of a pair of in-line skates A, A therein, with the position fasteners 14, 14 constricted, permitting the bottoms of the wheel bags to contact directly on the ground. Then the person can walk with the pairs of in-line skates worn and go upstairs or downstairs safely without sliding around or soiling the floor of a room or a cabinet where they are stored.

As can be understood, the invention has the following advantages;

1. It can serve for carrying a pair of in-line skates, held on a hand, a shoulder or the neck.
2. When it is not to be used during using a pair of in-line skates, it can be used for placing a pair of shoes therein instead of the skates so that the shoes may not be lost or soiled, convenient for carrying them in a hand, on a shoulder or the neck of a user.
3. It can be used for walking on the ground or going upstairs or downstairs with a pair of in-line skates worn on the feet and with it bound around the wheel wheel unit.
4. It is made of a soft cotton cloth, preventing the wheel units of a pair of in-line skates from sliding.
5. It can prevent the floor of a room from being soiled or serve for walking with safety and stability, bound around the wheel units of a pair of skates.
6. It is made of soft cotton, convenient to be folded and carried in a pocket.
7. It can be adapted to different sized skates made by different makers.

While the preferred embodiment of the invention has been described above, it will be recognized and understood that various modifications may be made therein and the appended claims are intended to cover all such modifications which may fall within the spirit and scope of the invention.

What is claimed is:

1. A wheel bag for an in-line skate to be placed around a wheel unit of the skate, comprising a longitudinal opening formed in an upper side, a vertical opening formed in a vertical side, a hollow interior for placing a wheel unit of an in-line skate therein, said longitudinal opening defined by two longitudinal edges containing a constrict band extending through said two longitudinal edges and out of a right end and then connected with a position fastener movable along said constrict band, said constrict band of a first wheel bag having its outer end fixed with a male fastener via said position fastener, said constrict band of a second wheel bag having its outer end fixed with a female fastener via said position fastener, a longitudinal slide-proof sheet attached on an outer bottom; and, said constrict band of said opening edges constricted by moving said position fastener nearer to the right end of said longitudinal opening with said wheel bag covered around on said wheel unit, said male fastener of a first of said wheel bags engaged with said female fastener of a second of said wheel bags for carrying said pair of in-line skates on a hand, a shoulder, or the neck, said wheel bags carrying a pair of shoes of a user therein with the pair of skates worn on the feet of the user so as to prevent said shoes from being lost or soiled and to carry along at the same time during skating, said slide-proof sheet directly contacting the ground so as to prevent said skates from sliding in walking or going upstairs or downstairs with said wheel bags containing said wheel units of said skates.

2. The wheel bag for an in-line skate as claimed in claim 1, wherein a carry band is further provided, having a male fastener fixed at one end and a female fastener fixed at the other end thereof so as to engage respectively with said female fastener and said male fastener of said two wheel bags for carrying in a hand, on a shoulder or a neck.

* * * * *